United States Patent [19]

Lewis, Jr.

[11] Patent Number: 4,869,860

[45] Date of Patent: Sep. 26, 1989

[54] SPINNING PROCESS FOR AROMATIC POLYAMIDE FILAMENTS

[75] Inventor: George K. Lewis, Jr., Chadds Ford, Pa.

[73] Assignee: E. I. Du Pont De Nemours and Company, Wilmington, Del.

[21] Appl. No.: 639,084

[22] Filed: Aug. 9, 1984

[51] Int. Cl.[4] ..... D01D 5/06

[52] U.S. Cl. ..... 264/180; 264/184; 425/71

[58] Field of Search ..... 264/179, 180, 181, 184, 264/176 F; 425/71, 464

[56] References Cited

U.S. PATENT DOCUMENTS

| | | | |
|---|---|---|---|
| 2,324,397 | 7/1943 | Hull | 264/181 |
| 3,428,289 | 2/1969 | Heckrotte et al. . | |
| 3,705,227 | 12/1972 | Fintel et al. | 264/176 F |
| 3,707,593 | 12/1972 | Fukada et al. | 264/176 F |
| 3,767,756 | 10/1973 | Blades | 264/184 |
| 4,261,943 | 4/1981 | McCorsley, III | 264/181 |
| 4,340,559 | 7/1982 | Yang | 264/181 |

*Primary Examiner*—James Lowe

[57] ABSTRACT

Process for producing high-strength, aromatic polyamide filaments by delivering substantially uniform amounts of a spinning solution to a plurality of apertures in a spinneret plate, extruding the solution downwardly in a single vertical warp through a noncoagulating fluid and into a gravity-accelerated and free-falling coagulating fluid.

14 Claims, 3 Drawing Sheets

SPINNING PROCESS FOR AROMATIC POLYAMIDE FILAMENTS

FIELD OF THE INVENTION

This invention relates to an improved process for the production of aromatic polyamide filaments. More particularly, this invention relates to a process of producing a plurality of aromatic polyamide filaments which as a group have higher elongation and higher strength than can be produced with previously known spinning techniques.

BACKGROUND AND PRIOR ART

Blades, U.S. Pat. No. 3,767,756, describes the spinning of anisotropic acid solutions of aromatic polyamides into a noncoagulating fluid, for example, air, and then into a coagulating liquid, for example, water.

Yang, U.S. Pat. No. 4,340,559, describes an improved process over that disclosed in Blades. In Yang, the anisotropic spinning solution is passed through a layer of noncoagulating fluid and into a shallow bath of coagulating (and quenching) liquid and out through an orifice at the bottom of the bath. The flow in the bath and through the outlet orifice is nonturbulent. In Yang, some of the filaments (i.e., extruded solution) contact the coagulating bath at a different angle than other filaments do. In Yang, the path of the filaments (extruded solution) through the noncoagulating fluid varies in length from one filament to another. In Yang, the filaments that are extruded from the circle of apertures closer to the center of the spinneret are contacted by coagulating fluid that has a somewhat different composition than the liquid that contacts the filaments that are formed at spinneret apertures at the outer edge of the spinneret—due of course to the coagulating liquid having become "contaminated" with the sulfuric acid leached from the fibers situated near the perimeter.

BRIEF DESCRIPTION OF THE INVENTION

The present invention is a process for simultaneously producing (spinning) a plurality of high-strength, high-modulus aromatic polyamide filaments, improved over known prior art, from aromatic polyamides that have chain extending bonds which are coaxial or parallel and oppositely directed and an inherent viscosity of at least 4.0. The property improvement is achieved by uniformizing solution flow, quench and coagulation. The fiber is produced by spinning an anisotropic solution of at least 30 grams of the polyamide in 100 ml of 98.0 to 100.2% sulfuric acid. The solution is delivered in a substantially uniform amount to each of a plurality of apertures which have a substantially uniform size and shape to obtain a substantially constant flow rate. The solution is then extruded downward through said plurality of apertures forming a single vertical warp, and vertically downward through a substantially uniformly thick layer of noncoagulating fluid (constant filament path length). Warp is here defined as an array of filaments aligned side-by-side and essentially parallel. The solution then passes vertically downward into a gravity-accelerated and free-falling coagulating liquid which provides equivalent bath composition at the point of initial coagulation. As shown in FIGS. 1 and 7, the gravity-accelerated and free-falling liquid is falling vertically. The gravity-accelerated and free-falling liquid into which the extruded solution passes may be obtained in the described condition by passing the liquid over the edge of a continuously supplied reservoir so that the liquid forms a waterfall. The term "waterfall" as used in the specification and claims describes the appearance and action of the freely-falling, gravity-accelerated coagulating liquid in the process, but the term does not limit the coagulating liquid to only water. The edge of the reservoir over which the liquid flows may be straight, thus forming a planar waterfall; or the edge of the reservoir over which the liquid flows may be curved thus forming a horseshoe shaped or even circular waterfall. The shape of the waterfall must conform to the shape of the single vertical warp in which the anisotropic solution is extruded. The single vertical warp in which the anisotropic solution is extruded may be planar, or a smooth curved cylindrical array including that directed by a circle. The extruded solution should enter the coagulating liquid at a point in the shoulder of the waterfall.

After the extruded solution has contacted the coagulating (and quenching) solution, it forms a fiber that may be contacted with additional coagulating liquid such as a side stream of liquid fed into the gravity-accelerated and free-falling coagulating liquid. Such a side stream should be fed into the existing stream in a nonturbulent manner and at about the speed of the moving fiber.

The preferred coagulating liquids are aqueous solutions, either water or water containing minor amounts of sulfuric acid. The coagulating liquid is usually at an initial temperature of less than 10° C., often less than 5° C.

The spinning solution is often at a temperature above 20° C. and usually about 80° C. A preferred spinning solution is one that contains poly(p-phenylene terephthalamide). Other examples of appropriate aromatic polyamides or copolyamides are described in U.S. Pat. No. 3,767,756.

The apertures of the spinneret plate are preferably in a single row or a closely-spaced, staggered double row. Staggered arrays of three to five rows are less preferred because the improvement diminishes as it is more difficult for the extruded filaments to converge into a single warp.

At times, it is desirable to be able to separate groups of filaments from other filaments that are simultaneously spun from the same spinneret. This separation may be more easily accomplished if the apertures in the spinneret are in groups and the groups are spaced further apart than the individual apertures in the groups.

The process of the invention is usually carried out under conditions where the noncoagulating fluid layer is less than 10 mm thick, and at speeds such that the resulting filament is taken away faster than 300 meters per minute.

DETAILED DESCRIPTION

Figure 1:
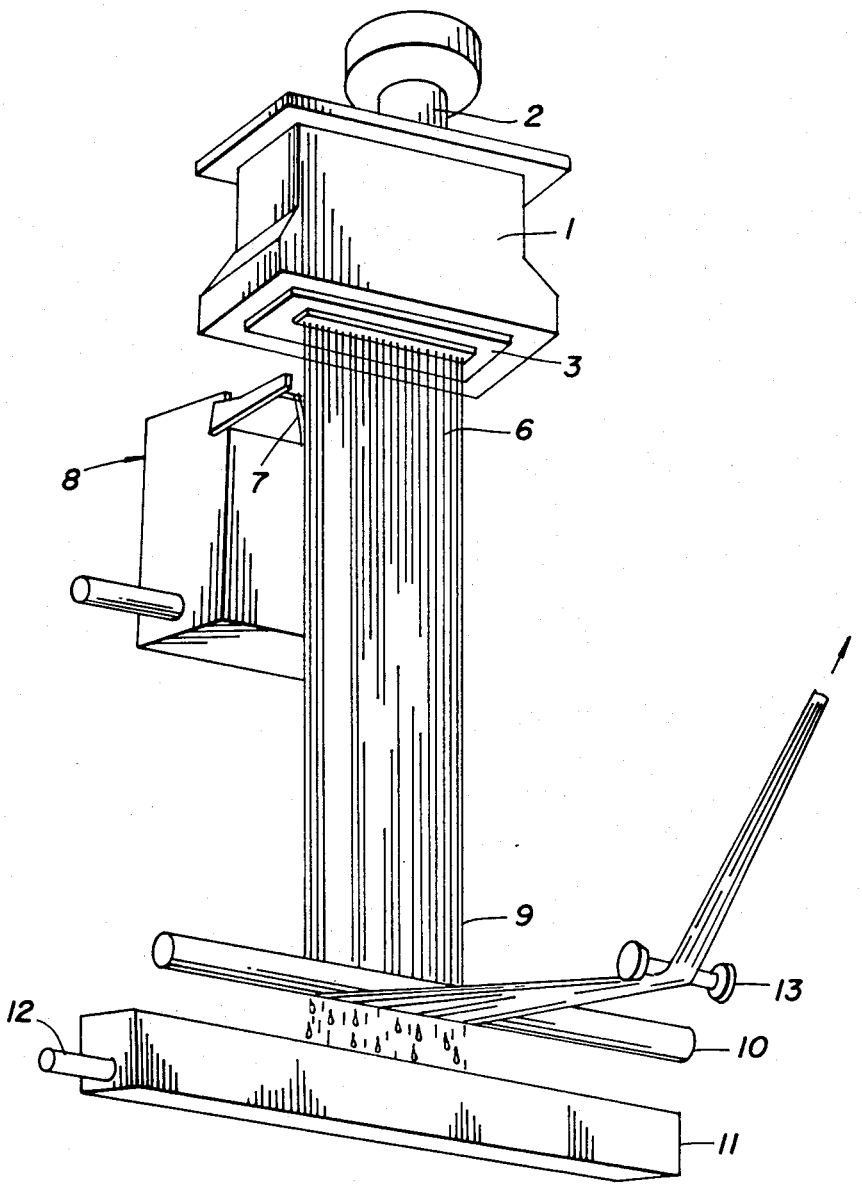
FIG. 1 is a perspective view of apparatus suitable to carry out the process of the invention.
Figure 7:
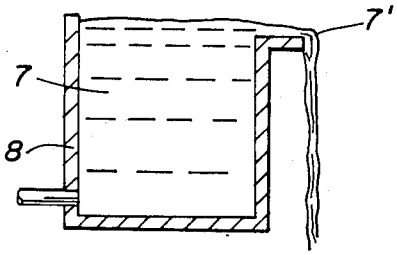
FIG. 7 is a cross-sectional view through a coagulation fluid reservoir of the type shown in FIG. 1.

The process of this invention can be easily understood by reference to the accompanying drawings in which like features are enumerated with like numbers. Referring then to FIG. 1, wherein spinning solution distribution pack 1, with attendant spinning solution supply pipe 2, and spinneret plate 3 having the spinneret apertures 5 (see FIG. 5) arranged in a linear array, is shown to be extruding spinning solution in filamentary form 6. The extruded solution than passes into a coagulating liquid 7, fed from reservoir 8 at the shoulder of the liquid 7' (see FIG. 7), which liquid at the time the extruded solution contacts it, is free-falling and gravity-accelerated. (The liquid is also accelerated by the movement of the extruded (now coagulating) solution through the liquid.) The extruded solution cools (quenches) and coagulates to form fiber, and the fibers 9 are separated from the coagulating liquid by changing the direction of fiber movement by passing the fibers around spindle 10. The coagulating liquid continues its gravity accelerated path into collecting tank 11 having a drain connection 12. The filaments are then brought together by gathering spindle 13 and then continued through conventional processing steps.

The internal structure of spinning-solution-distribution pack 1 is shown in FIGS. 2, 2A, 3 and 4. The centrally located cylindrical supply channel 14, in operation allows spinning solution to pass through it to trapezoidal delivery channel 15. The trapezoidal delivery channel diminishes in cross-sectional area from the center to the end. The trapezoidal delivery channel 15, see FIGS. 3 and 4, has a back wall 16, an upper surface 17, and a lower surface 18. In operation, spinning solution passes through the trapezoidal delivery channel 15 and across the surface 19 and then through spinneret apertures 5, see FIG. 5.

The exact shape of the trapezoidal delivery channel necessary to deliver a substantially uniform amount of fluid across face 19, and accordingly a substantially uniform flow to each spinneret aperture is defined by equations set forth and explained in Heckrotte et al., U.S. Pat. No. 3,428,289.

Figure 2:
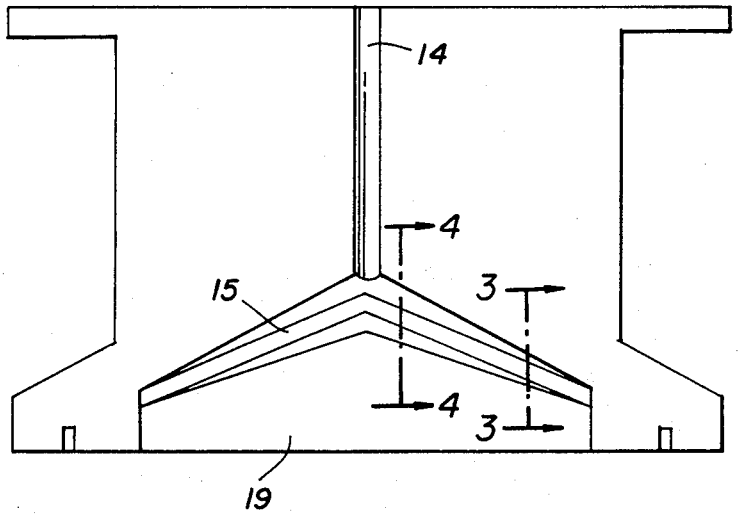
FIG. 2 is a perspective view of one side of a spinning-solution distribution pack.
Figure 2A:
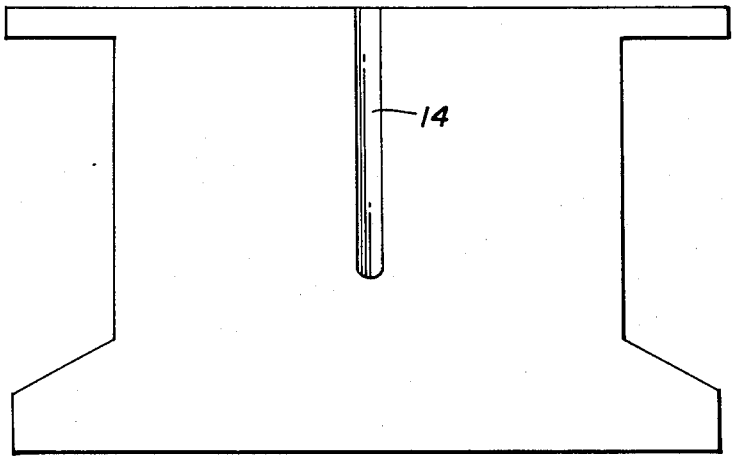
FIG. 2A is a perspective view of the other side of a distribution pack.
Figure 3:
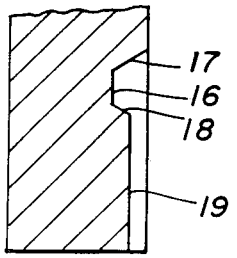
FIG. 3 is a cross-sectional view of a portion of the distribution pack of FIG. 2 taken on lines 3—3 of FIG. 2.
Figure 4:
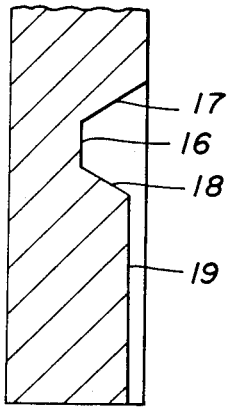
FIG. 4 is a cross-sectional view of a portion of the distribution pack of FIG. 2 taken on lines 4—4 of FIG. 2.

The other side of the distribution pack is shown in FIG. 2A. The only significant feature of this side being that it contains the other half of supply channel 14. Aside from this feature, the side shown in FIG. 2A is a flat plate.

Figure 5:
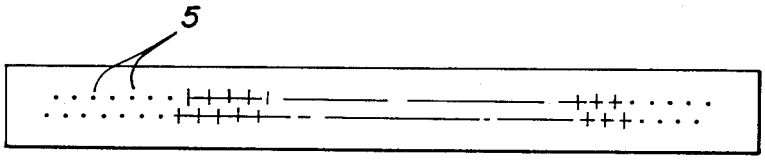
FIG. 5 is a plan view of a spinneret plate suitable for attachment to the pack of FIG. 2.

In the spinneret plate depicted in FIG. 5, the spinneret apertures 5 are in closely spaced staggered rows.

Figure 6:
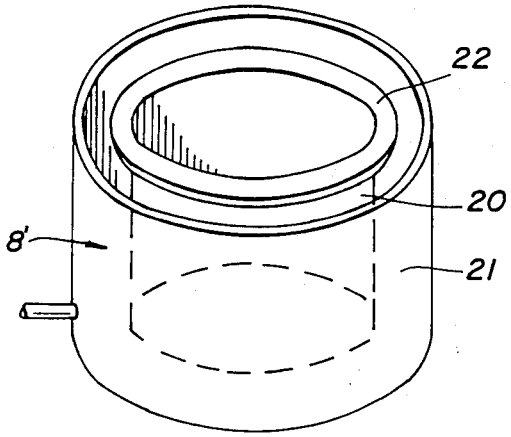
FIG. 6 is a perspective view of an alternative form of coagulating liquid reservoir suitable for use with a spinneret having a circular array of apertures.

FIG. 6 depicts an alternative coagulating fluid reservoir 8' of cylindrical shape having an inner wall 20 that is shorter than outer wall 21, and a lip 22 on the inner wall 20 over which coagulating fluid may flow. The embodiment shown in FIG. 6 would be used with a spinneret having apertures arranged in a circle.

EXAMPLE I

Poly(p-phenylene terephthalamide) is dissolved in 100.05% $H_2SO_4$ to form a 19.6% (by weight) spinning solution (44.6 g per 100 ml) ($\eta$inh measured on yarn is 4.9). This solution is heated to about 80° C. and passed through a pack designed as shown in FIGS. 1, 2, 2A, 3 and 4 to provide constant flow to each orifice in a linear array spinneret.

The spinneret in this example has 1000 apertures in a straight single line (1 row) spaced on 0.15 mm centers. The length to diameter ratio, L/D, of the capillaries is 3.2 with a diameter, D, of 0.064 mm. The extruded solution (filaments) is passed through an air-gap of 4.8 mm and into water maintained at 0° to 5° C. The water is supplied in a controlled waterfall from a one-sided coagulation and quench device such as shown in FIG. 1, in a metered flow at 6 gallons per minute. The distance between the spinneret 3 and the spindle 10 is about one meter. The coagulated filaments are then forwarded, washed, neutralized, dried and wound up at 549 meters per minute.

The 1000 filament yarn prepared in this example is compared to conventionally spun yarn in Table I. The conventional spinning technique used for comparison employed a circular spinneret with the 1000 apertures (0.064 mm in diameter) arranged in concentric circles (within a 1.5' diameter outer circle). Filaments were spun with the above solution from this circular array into a shallow, coagulating water bath (or tray) corresponding to "Tray G" shown in FIG. 1 of U.S. Pat. No. 4,340,559 and described therein.

EXAMPLE II

Using the spin solution and linear (1 row) spinneret of Example I the effect of varying the water flow rate to the waterfall quench is examined. Results are compared with Example I in Table I.

EXAMPLE III

Using the spin solution of Example I the linear (1 row) spinneret-waterfall quench is compared to the circular array-shallow quench at a larger air-gap, 12.7 mm, at varying quench flow rates. Results are shown in Table I.

EXAMPLE IV

Another poly(p-phenylene terephthalamide) solution (19.4% by weight in 100.05% $H_2SO_4$) is spun at about 80° C. in this example which compares the linear (1 row) spinneret-waterfall quench with the circular array-shallow quench at various spinning speeds and quench flow rates using a 4.8 mm air-gap. Results are shown in Table I.

EXAMPLE V

In this example, yarns spun from different linear spinnerets (i.e. spinnerets where the apertures are in a straight row or closely spaced straight rows) containing 1, 3 or 5 rows of apertures using the waterfall quench are compared to those from a circular array-shallow quench at varius spinning speeds. The linear (3 row) spinneret has 1000 orifices in 3 staggered rows spaced 0.51 mm apart with the apertures on 0.48 mm centers. The linear (5 row) spinneret has 1000 apertures in 5 staggered rows spaced 0.81 mm apart with the apertures on 0.81 mm centers. A 19.7% (by weight) solution of poly(p-phenylene terephthalamide) in 100.04% $H_2SO_4$ is spun at about 80° C. ($\eta$inh measured on yarn is 4.9). Results are in Table I.

EXAMPLE VI

A 19.5% (by weight) solution of poly(p-phenylene terephthalamide) in 100.05% $H_2SO_4$ is used to compare the linear (3 row) spinneret-waterfall quench to a circular array-shallow quench at various spinning speeds and quench flow rates using a 4.8 mm air-gap. Results are shown in Table I.

EXAMPLE VII

A 19.5% (by weight) solution of poly(p-phenylene terephthalamide) in 100.06% $H_2SO_4$ is used to compare the linear (5 row) spinneret-waterfall quench to a circular array-shallow quench at various quench flow rates and air-gap settings. Results are shown in Table I.

EXAMPLE VIII

A 19.4% (by weight) solution of poly(p-phenylene terephthalamide) in 100.06% $H_2SO_4$ is used to compare the linear (5 row) spinneret-waterfall quench to a circular array-shallow quench at various quench rates. Results are shown in Table I.

EXAMPLE IX

This example illustrates the use of a spinneret with apertures in a linear array formed by two staggered rows of 500 apertures each. (The center-to-center distance between apertures in a row is 0.31 mm and between rows is 0.71 mm; the capillary diameter of the apertures is 0.076 mm.) A poly(p-phenylene terephthalamide) solution (18.8% by weight in 100.05% $H_2SO_4$) is spun with this spinneret at about 80° C. using the constant flow pack and waterfall, coagulation-quench device of Example I.

The resulting yarn is compared to a control yarn spun from another poly(p-phenylene terephthalamide) solution (19% by weight in 100.05% $H_2SO_4$) using the conventional circular spinneret with apertures arranged in concentric circles and the shallow, coagulation tray referred to in Example I. The results are shown in Table I.

TABLE I

| Spin Speed (m/min) | Spinneret | Quench Device | Quench Flow (Gal/min) | Air gap (mm) | Yarn Properties Denier | Tenacity (gpd) | Elong. (%) | Modulus (gpd) |
|---|---|---|---|---|---|---|---|---|
| Example 1: | | | | | | | | |
| 549 | Linear (1) | Waterfall | 7 | 4.8 | 1380 | 21.2 | 3.9 | 415 |
| 549 | Circular | Tray | 7 | 4.8 | 1250 | 18.6 | 3.4 | 451 |
| Example 2: | | | | | | | | |
| 549 | Linear (1) | Waterfall | 2 | 4.8 | 1380 | 21.0 | 4.0 | 401 |
| 549 | Linear (1) | Waterfall | 4 | 4.8 | 1361 | 21.5 | 3.8 | 433 |
| 549 | Linear (1) | Waterfall | 8 | 4.8 | 1361 | 21.1 | 4.0 | 408 |
| Example 3: | | | | | | | | |
| 549 | Linear (1) | Waterfall | 2 | 12.7 | 1393 | 20.8 | 3.9 | 415 |
| 549 | Linear (1) | Waterfall | 4 | 12.7 | 1361 | 20.7 | 3.9 | 438 |
| 549 | Linear (1) | Waterfall | 6 | 12.7 | 1328 | 20.3 | 3.8 | 440 |
| 549 | Linear (1) | Waterfall | 8 | 12.7 | 1320 | 20.7 | 3.8 | 433 |
| 549 | Circular | Tray | 7 | 12.7 | 1249 | 17.0 | 3.3 | 432 |
| Example 4: | | | | | | | | |
| 457 | Linear (1) | Waterfall | 8 | 4.8 | 1614 | 20.7 | 3.9 | 408 |
| 549 | Linear (1) | Waterfall | 2 | 4.8 | 1670 | 21.4 | 4.2 | 375 |
| 549 | Linear (1) | Waterfall | 4 | 4.8 | 1661 | 21.1 | 4.0 | 395 |
| 549 | Linear (1) | Waterfall | 6 | 4.8 | 1640 | 20.7 | 4.0 | 397 |
| 549 | Linear (1) | Waterfall | 8 | 4.8 | 1647 | 20.3 | 3.9 | 401 |
| 684 | Linear (1) | Waterfall | 8 | 4.8 | 1553 | 19.4 | 3.8 | 401 |
| 457 | Circular | Tray | 6 | 4.8 | 1550 | 19.5 | 3.6 | 415 |
| 549 | Circular | Tray | 6 | 4.8 | 1543 | 18.0 | 3.5 | 408 |
| 684 | Circular | Tray | 6 | 4.8 | 1500 | 17.3 | 3.6 | 389 |
| Example 5: | | | | | | | | |
| 457 | Linear (1) | Waterfall | 5 | 4.8 | 1700 | 22.1 | 4.1 | 420 |
| 549 | Linear (1) | Waterfall | 5 | 4.8 | 1728 | 21.4 | 4.1 | 402 |
| 684 | Linear (1) | Waterfall | 5 | 4.8 | 1743 | 20.2 | 4.0 | 396 |
| 457 | Linear (3) | Waterfall | 5 | 4.8 | 1783 | 20.3 | 3.9 | 414 |
| 549 | Linear (3) | Waterfall | 5 | 4.8 | 1809 | 19.4 | 3.8 | 400 |
| 684 | Linear (3) | Waterfall | 5 | 4.8 | 1837 | 18.8 | 3.8 | 381 |
| 457 | Linear (5) | Waterfall | 5 | 4.8 | 1789 | 20.0 | 3.8 | 395 |
| 549 | Linear (5) | Waterfall | 5 | 4.8 | 1829 | 19.6 | 3.9 | 380 |
| 684 | Linear (5) | Waterfall | 5 | 4.8 | 1855 | 18.7 | 3.8 | 373 |
| 457 | Circular | Tray | 5 | 4.8 | 1677 | 19.4 | 3.8 | 402 |
| 549 | Circular | Tray | 5 | 4.8 | 1667 | 19.0 | 3.7 | 419 |
| 684 | Circular | Tray | 5 | 4.8 | 1700 | 18.4 | 3.8 | 387 |
| Example 6: | | | | | | | | |
| 457 | Linear (3) | Waterfall | 5 | 4.8 | 1726 | 21.8 | 3.9 | 455 |
| 549 | Linear (3) | Waterfall | 3 | 4.8 | 1705 | 19.8 | 3.9 | 417 |
| 549 | Linear (3) | Waterfall | 5 | 4.8 | 1708 | 20.4 | 3.8 | 436 |
| 549 | Linear (3) | Waterfall | 7 | 4.8 | 1687 | 20.7 | 3.8 | 436 |
| 684 | Linear (3) | Waterfall | 5 | 4.8 | 1771 | 19.8 | 3.7 | 432 |
| 457 | Circular | Tray | 6 | 4.8 | 1666 | 19.5 | 3.7 | 442 |
| 549 | Circular | Tray | 6 | 4.8 | 1650 | 18.7 | 3.6 | 442 |
| 684 | Circular | Tray | 7 | 4.8 | 1706 | 19.0 | 3.7 | 419 |
| Example 7: | | | | | | | | |
| 549 | Linear (5) | Waterfall | 4 | 4.8 | 1704 | 20.1 | 3.8 | 423 |
| 549 | Linear (5) | Waterfall | 5.5 | 4.8 | 1722 | 20.3 | 3.6 | 450 |
| 549 | Linear (5) | Waterfall | 7 | 4.8 | 1707 | 20.8 | 3.7 | 456 |
| 549 | Linear (5) | Waterfall | 4 | 12.7 | 1691 | 20.2 | 3.7 | 458 |

TABLE I-continued

| Spin Speed (m/min) | Spinneret | Quench Device | Quench Flow (Gal/min) | Air gap (mm) | Yarn Properties Denier | Tenacity (gpd) | Elong. (%) | Modulus (gpd) |
|---|---|---|---|---|---|---|---|---|
| 549 | Linear (5) | Waterfall | 4 | 25.4 | 1687 | 19.7 | 3.7 | 438 |
| 549 | Circular | Tray | 5 | 4.8 | 1597 | 18.7 | 3.5 | 456 |
| 549 | Circular | Tray | 5 | 12.7 | 1595 | 17.8 | 3.4 | 434 |
| 549 | Circular | Tray | 5 | 25.4 | 1576 | 17.7 | 3.5 | 409 |
| Example 8: | | | | | | | | |
| 549 | Linear (5) | Waterfall | 1.5 | 7.9 | 1693 | 19.4 | 3.9 | 386 |
| 549 | Linear (5) | Waterfall | 2.2 | 7.9 | 1689 | 19.6 | 3.8 | 417 |
| 549 | Linear (5) | Waterfall | 3.2 | 7.9 | 1695 | 20.2 | 3.8 | 435 |
| 549 | Linear (5) | Waterfall | 4.2 | 7.9 | 1682 | 20.3 | 3.7 | 458 |
| 549 | Circular | Tray | 5 | 7.9 | 1680 | 19.5 | 3.6 | 489 |
| Example 9: | | | | | | | | |
| 457 | Linear (2) | Waterfall | 2.5 | 7.9 | 1653 | 21.6 | 4.0 | 439 |
| 457 | Circular | Tray | 6 | 4.8 | 1653 | 20.0 | 3.4 | 582 |

I claim:

1. A process for simultaneously producing a plurality of high-strength, high-modulus aromatic polyamide filaments from aromatic polyamides with chain extending bonds which are coaxial or parallel and oppositely directed and an inherent viscosity of at least 4.0, which comprises (a) delivering substantially uniform amounts of an anisotropic solution of at least 30 grams of the polyamide in 100 ml of 98.0 to 100.2% sulfuric acid to each of a plurality of substantially uniform size apertures of a spinneret plate, (b) extruding said anisotropic solution downward through said plurality of apertures forming a single vertical warp and vertically downward through a gap of constant filament path length, (c) coagulating said extruded anisotropic solution after passing through said gap of constant filament path length by passing said extruded anisotropic solution vertically downward into a gravity-accelerated and vertically-free-falling coagulating liquid.

2. The process of claim 1 in which the extruded anisotropic solution enters the gravity-accelerated and vertically free-falling coagulating liquid at a point in the shoulder of a waterfall of the coagulating liquid.

3. The process of claim 1 in which the single vertical warp in which the solution is extruded downward is planar.

4. The process of claim 1 in which the single vertical warp in which the solution is extruded downward is a smooth curved cylindrical array.

5. The process of claim 4 in which the smooth curved cylindrical array is defined by a circle.

6. The process of claim 1 in which the coagulated product is contacted with additional liquid which is applied in a nonturbulent manner.

7. The process of claim 6 in which both the coagulating liquid and the additional liquid comprise an aqueous solution.

8. The process of claim 1 in which the apertures of the spinneret plate exist in a single straight row.

9. The process of claim 1 in which the apertures of the spinneret plate exist in a few closely spaced, staggered straight rows.

10. The process of claim 1 in which the apertures of the spinneret plate exist in a few closely spaced, staggered rows.

11. The process of claim 8 in which the apertures of the spinneret are in groups and the groups are spaced farther apart than are the individual apertures of the groups.

12. The process of claim 1 in which the polyamide is poly(p-phenylene terephthalamide) and in which the anisotropic solution is extruded at about 80° C., and in which the coagulating solution is at a temperature of less than about 10° C.

13. The process of claim 1 in which the gap of constant filament path length contains air, and the gap is less than about 10 mm.

14. The process of claim 1 in which the coagulated product is processed at a speed in excess of 300 meters per minute.

* * * * *